US005809367A

United States Patent [19]

Yoo et al.

[11] Patent Number: 5,809,367

[45] Date of Patent: Sep. 15, 1998

[54] METHOD OF AUTOMATICALLY CONTROLLING TRANSFER VOLTAGE AND FUSING TEMPERATURE IN AN ELECTROPHOTOGRAPHIC PRINTING APPARATUS

[75] Inventors: Young-Sang Yoo; Ki-Jae Do, both of Suwon, Rep. of Korea

[73] Assignee: SamSung Electronics Co., Ltd., Suwon, Rep. of Korea

[21] Appl. No.: 814,861

[22] Filed: Mar. 10, 1997

[30] Foreign Application Priority Data

Mar. 8, 1996 [KR] Rep. of Korea ..... 6016/1996

[51] Int. Cl.[6] ..... G03G 15/00; G03G 21/00

[52] U.S. Cl. ..... 399/45; 399/66; 399/69; 430/124; 430/126

[58] Field of Search ..... 399/45, 69, 33, 399/66, 81, 85, 314, 389, 392, 77, 8; 219/216; 430/124, 126

[56] References Cited

U.S. PATENT DOCUMENTS

| | | | |
|---|---|---|---|
| 4,373,801 | 2/1983 | Itoh | 399/45 |
| 4,439,143 | 3/1984 | Hanamoto et al. | 432/36 |
| 4,634,262 | 1/1987 | Imaizumi et al. | 399/45 |
| 4,719,489 | 1/1988 | Ohkubo et al. | 399/45 |
| 4,822,977 | 4/1989 | Leising et al. | 219/216 |
| 5,008,715 | 4/1991 | Imaizumi et al. | 399/392 |
| 5,073,801 | 12/1991 | Haneda et al. | 399/45 |
| 5,099,287 | 3/1992 | Sato | 399/45 |
| 5,321,481 | 6/1994 | Mathers | 399/69 |
| 5,325,166 | 6/1994 | Hamilton et al. | 399/45 |
| 5,331,384 | 7/1994 | Ohtsuka | 399/45 |
| 5,361,124 | 11/1994 | Rowe et al. | 399/33 |
| 5,373,354 | 12/1994 | Tadokoro et al. | 399/45 |
| 5,486,903 | 1/1996 | Kannon et al. | 399/45 |
| 5,512,992 | 4/1996 | Kim et al. | 399/69 |
| 5,568,229 | 10/1996 | Szlucha | 399/43 |
| 5,717,977 | 2/1998 | Suzuki et al. | 399/45 |

FOREIGN PATENT DOCUMENTS

| | | |
|---|---|---|
| 56-69645 | 8/1981 | Japan . |
| 6-332275 | 12/1994 | Japan . |
| 8-254927 | 10/1996 | Japan . |

*Primary Examiner*—Arthur T. Grimley
*Assistant Examiner*—Sophia S. Chen
*Attorney, Agent, or Firm*—Robert E. Bushnell, Esq.

[57] ABSTRACT

A method of automatically controlling an electrophotographic printing apparatus' transfer voltage and fusing temperature according to the type of paper by an automatic mode change during manual paper feeding which includes the steps of following a manual feed option being selected, automatically converting the apparatus's normal paper mode into a paper selection mode in response to the manual paper feeding; and when a keyboard input is made indicating a change in the type of paper, setting the transferring voltage and fusing temperature according to the keyboard input and printing images corresponding to image data from a host computer system on the paper.

20 Claims, 4 Drawing Sheets

METHOD OF AUTOMATICALLY CONTROLLING TRANSFER VOLTAGE AND FUSING TEMPERATURE IN AN ELECTROPHOTOGRAPHIC PRINTING APPARATUS

CLAIM FOR PRIORITY

This application makes reference to, incorporates the same herein, and claims all benefits accruing under 35 U.S.C. §119 from an application for Method Of Automatically Controlling Transfer Voltage And Fusing Temperature In An Electrophotographic Printing Apparatus earlier filed in the Korean Industrial Property Office on 8 Mar. 1996 and there duly assigned Ser. No. 6016/1996.

BACKGROUND OF THE INVENTION

1. Technical Field

The present invention relates to an electrophotographic printing apparatus, and more particularly, relates to a method of automatically controlling transfer voltages and fusing temperatures of an electrophotographic printing apparatus during manual paper feeding by an automatic mode conversion.

2. Related Art

Electrophotography is widely used in computer printers, facsimile machines and photocopiers in order to produce images on recording media in response to video signals. A common example of an electrophotographic printing apparatus is a laser beam printer which prints images on individual sheet of paper through a series of electrostatic image-forming steps. Generally, the process of electrostatic image forming includes charging a photosensitive drum to a substantially uniform potential so as to sensitize the surface thereof. The charged portion of the photosensitive drum is exposed to a light image to record an electrostatic latent image on its surface. The latent image is then developed by applying toner from a developing unit onto the photosensitive drum which is subsequently transferred and fixed on a recording medium. When a toner image is fixed on a recording medium, the toner image is first heated and fused onto the recording medium, and then naturally cooled so that it is fixed onto the recording medium.

One preferred fusing method is to provide a fuser fixing device used for fixing an image on a recording medium which consists of a fuser roller and a pressure roller. The fuser roller is typically heated to bring the pair of coactive rollers into contact with each other, thereby forming a nipping and fusing section. The recording medium is passed through this nipping and fusing section to fix the toner aligned thereon. When the recording medium is passed through the nipping and fusing section, the aligned toner which forms an image on the recording medium is heated and at the same time subjected to pressure. The heat energy and pressure applied at the nipping and fusing section changes the shape of the toner. This action causes the toner to be fixed onto the recording medium.

A significant problem in the conventional heated fuser roller systems is the temperature variations of the heat transferred to the fuser roll surface due to changes in the characteristics of the recording medium such as paper of different size and thickness. Recent efforts in the art to cope with the fusing temperature variations in accordance with paper of different size are disclosed in U.S. Pat. No. 5,361,124 for Temperature Control System For A Fuser issued to Rowe et al., U.S. Pat. No. 5,325,166 for Fuser Overheat Control issued to Hamilton et al., U.S. Pat. No. 5,321,481 for Fuser Temperature And Copy Output Controller issued to Mathers, and U.S. Pat. No. 5,331,384 for Fixing Apparatus Having Temperature Controller Which Controls Temperature According to Width Size And Number of Recording Sheets issued to Otsuka. For paper of special thickness such as overhead transparency, label and envelop, traditional efforts in the art such as disclosed, for example, in U.S. Pat. No. 4,634,262 for Toner Image Fixing Control Process And Apparatus In Electrostatic Copying Machine issued to Imaizumi and U.S. Pat. No. 4,373,801 for Fixing Temperature Selecting Control In A Copying Machine issued to Itoh, require the user to set the fuser roller system at a higher fusing temperature in a special paper selection mode to perform the fixing, or alternatively, to set the fuser roller system to a constant lower temperature in a normal paper selection mode at which the toner image can be fixed to thin paper so as to prevent the thin paper from burning. Multiple function key inputs are burdensome but necessarily required to convert the current mode of operation between the normal paper selection mode and the special paper selection mode.

Recent efforts in the art to regulate a desired fusing temperature in accordance with variations of paper characteristics are disclosed, for example, in U.S. Pat. No. 5,512,992 for Apparatus And Method For Controlling Fusing Temperature issued to Kim et al. and assigned to the same assignee of the instant application, U.S. Pat. No. 5,486,903 for Image Forming Apparatus With Paper Thickness Detector issued to Kanno et al., and U.S. Pat. No. 4,439,143 for Heat Roller Fixing Device issued to Hanamoto et al. In Hanamoto '143, for example, a changeover arrangement is installed to automatically change over to one of the normal paper selection mode and the special paper selection mode in accordance with the thickness of the recording medium. In Kanno '903, a sophisticated paper thickness detector in a form of an air capacitor having upper and lower conductor plates is installed to automatically detect the thickness of the recording medium. Once the thickness of the recording medium is detected, the optimum fuser temperature is computed from the detected thickness of the recording medium. Similarly, Kim '922 also uses a paper thickness detector for detecting the thickness of the recording medium in order to adjust the input reference fusing temperature to a desired value for fixing a toner image according thereto. While the efforts allow optimal image formation without fixing failure, it has been my observation that the installation of paper thickness detector in combination of other control devices can be cost prohibitive. Moreover, the inclusion of such a paper thickness detector wholly deprives the user the opportunity to control manual operation of the system such as a manual feed option.

SUMMARY OF THE INVENTION

Accordingly, it is therefore an object of the present invention to provide an improved printer method of automatically changing a paper selection mode and controlling a transfer voltage according to the type of paper that is fed into the printer through a manual feed option.

It is also an objective to provide a printer and method of automatically setting the printer's fusing temperature corresponding to a transfer voltage preset for the type of paper when the paper is fed into the printer through a manual feed slot.

These and other objects of the present invention can be achieved by a method of automatically controlling a transfer voltage and a fusing temperature in a printer according to different type of recording medium by an automatic mode change during manual paper feeding. The method includes the steps of automatically converting the printer's normal paper mode into a paper selection mode and requesting a user to make selection of the type of recording medium usable for printing operation, in response to input of a recording medium via a manual feed section of the printer; and when the user selects the type of recording medium paper usable for printing operation via a key input, setting the transfer voltage and fusing temperature according to the key input and printing images corresponding to image data from a host computer system onto the recording medium as the recording medium is being fed through the manual feed section of the printer.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
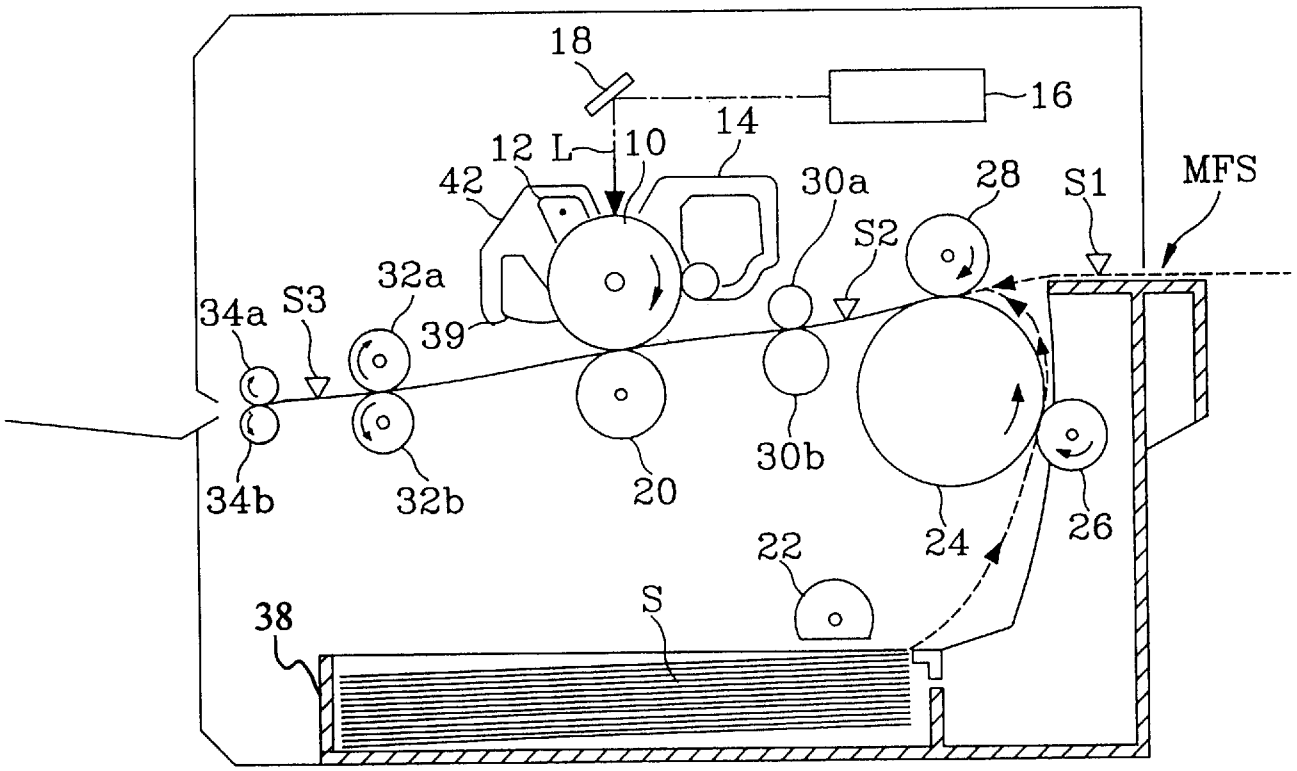
FIG. 1 illustrates an exemplary laser beam printer using an electrophotographic process.

Referring now to the drawings and particularly to FIG. 1, which illustrates an exemplary image forming apparatus such as a laser beam printer using an electrophotographic process. The laser beam printer includes a photosensitive drum 10, a charger 12, developing unit 14, a laser exposure unit 16, a mirror reflector 18, a transfer roller 20, a pick-up roller 22, a convey roller 24, a pair of idle rollers 26 and 28, a pair of registration rollers 30*a* and 30*b*, a fixing unit comprising a pair of coactive rollers which consists of a fuser roller 32*a* and a pressure roller 32*b*, a pair of output rollers 34*a* and 34*b*, and a cleaner 39. The charger 12 and the cleaner 39 are generally encased in the same house 42.

As shown in FIG. 1, the charger 12, creates a uniform static electric charge on the outer surface of the photosensitive drum 10. The laser exposure unit 16 generates a laser beam L corresponding to a time-serial electrical pixel signal of image information input from an original image reading unit (not illustrated), and traces the image on the outer surface of photosensitive drum 10 with the mirror reflector 18, so as to create a latent image on the surface of the photosensitive drum 10. The latent image is converted to a toner image by the developing unit 14.

The electrophotographic process begins when the pickup roller 22, picks up the uppermost sheet of paper S loaded in the paper cassette 38. The conveyor roller 24 working with the idler rollers 26 and 28 convey the paper to registration rollers 30*a* and 30*b*, where the paper is aligned. A transfer charge is applied to the outer surface of the photosensitive drum 10 by the transfer roller 20, to transfer the toner image onto the paper. After toner image is transferred onto the paper, the cleaner 39 removes any residual toner on the surface of the photosensitive drum 10, and the fixing unit fuses the toner image to the paper. The fixing unit includes a fuser roller 32*a* and a pressure roller 32*b*. Fuser roller 32*a* is heated by a heat lamp to fuse the toner image to the paper S.

The laser beam printer as shown in FIG. 1 also has sensors which monitor the operating state of the printer such as the paper conveyance state, the opening or the closing of the printer's cover. Sensors S1 to S3 are installed to monitor the paper conveyance state. The first sensor S1 is located between a manual feed slot (MFS) and the second idle roller 28 to monitor the status of the paper that is fed from the MFS. The second sensor S2 is located in the paper path between convey roller 24 and registration rollers 30*a* and 30*b* to monitor the status of the paper that is transferred to registration rollers 30*a* and 30*b*. The third sensor S3 is mounted in the paper output path between the fixing unit and paper output rollers 34*a* and 34*b* to monitor the state of paper discharged to the output tray (not illustrated).

The laser beam printer has an automatic feeder and a secondary manual feed slot. The automatic feeder is used to feed A4, B4, or letter-sized paper to the electrophotographic printing mechanism of the printer, and the secondary manual feed slot is used to allow the user to manually feed paper or special paper such as overhead transparencies, labels, envelopes, etc. The special paper may be thicker or even doubled the thickness of a normal paper, and can be difficult if not impossible to be fed into the automatic feeder. Overhead transparencies, which are large in size and thickness have higher resistance than normal paper's resistance. Thus, when such transparencies are used as the recording media, higher voltages should be applied to them when compared to those applied to the normal paper in order to produce documents with high print quality. The printer commonly adjusts the optimum conditions of electrostatic printing process to normal paper printing, and where the toner image is transferred to an overhead transparency, the density of the printed image decreases.

In order to enhance the print quality, it is necessary to control the transfer voltages according to the type of paper used. The printer typically requires the user to set the fuser roller system at a higher fusing temperature in a special paper selection mode to perform the fixing, or alternatively, to set the fuser roller system to a constant lower temperature in a normal paper selection mode at which the toner image can be fixed to thin paper so as to prevent the thin paper from burning. Multiple function key inputs are required to convert the current mode of operation between the normal paper selection mode and the special paper selection mode.

Figure 2:
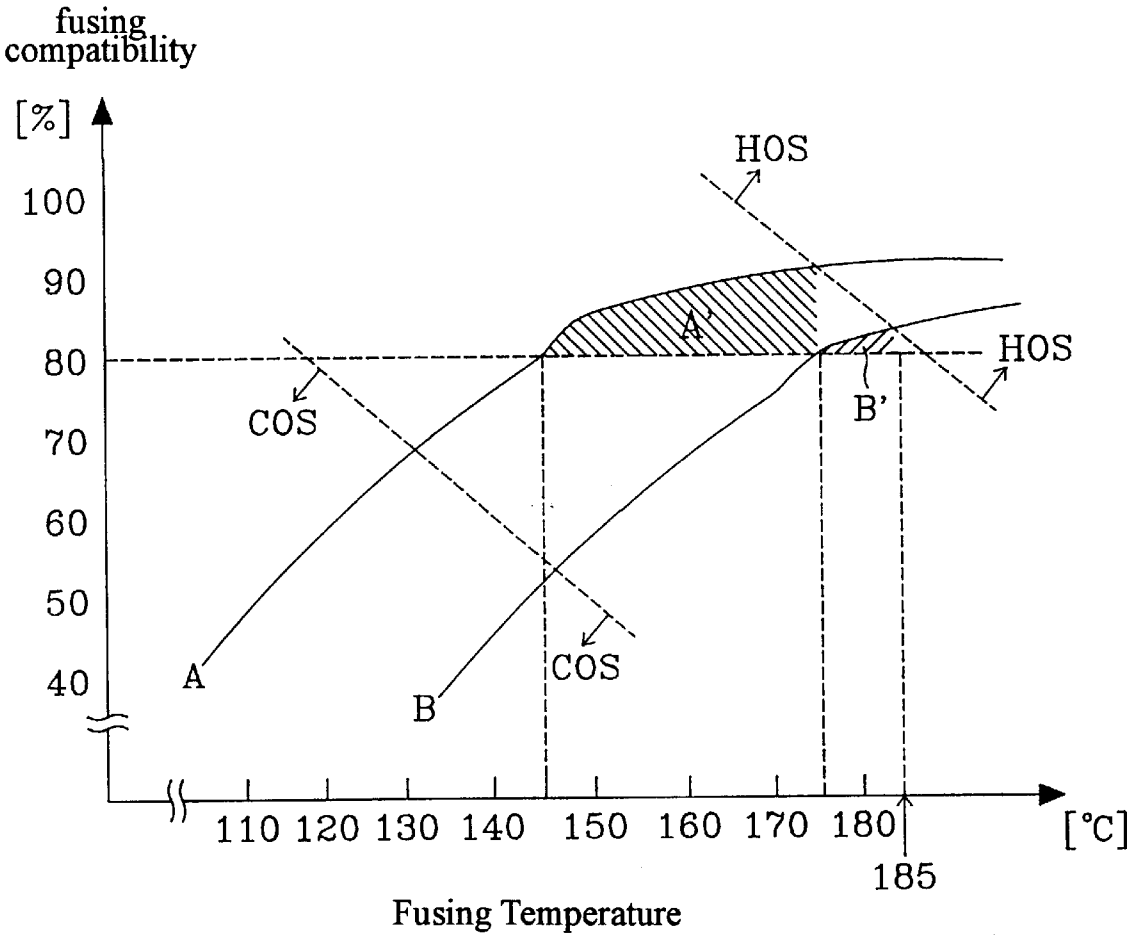
FIG. 2 is a graphical diagram illustrating the exemplary laser beam printer's fusing compatibility according to fusing temperature.

FIG. 2 illustrates the printer's fusing compatibility that varies with fusing temperatures in accordance with the type of paper used such as normal paper and special paper. Curve A indicates the toner image fusion on normal paper, and curve B corresponds to the toner image fusion on special paper which is fed through the manual feed option. The graph's horizontal and vertical axes correspond to fusing temperatures and fusing compatibility (%). The toner is fused to paper by heat and pressure of the fixing unit, and the loss of heat varies with the thickness of paper used. When the fusing temperature, set for normal paper, is applied to printing on special paper, the print quality deteriorates. A typical laser beam printer has fusing compatibility of 80% or more, where toner is satisfactorily fused to paper except cold offset (COS) and hot offset (HOS). In other words, an appropriate range of the printing environment for normal paper (A) corresponds to A', where the printer's fusing temperature appropriate for normal paper is 160°±15° C. In the same way, the fusing characteristics of special paper is represented by curve B, where B' represents an appropriate operating range where the printer's fusing temperature for the special paper is 185°±10° C. Generally, in the laser beam printer that can print normal paper A and special paper B, the printer's fusing temperature is set for the normal paper, where the toner images are not satisfactorily fused to the special paper. Since the printer's fusing temperature is not appropriately set for the type of paper, poor print quality often results.

Figure 3:
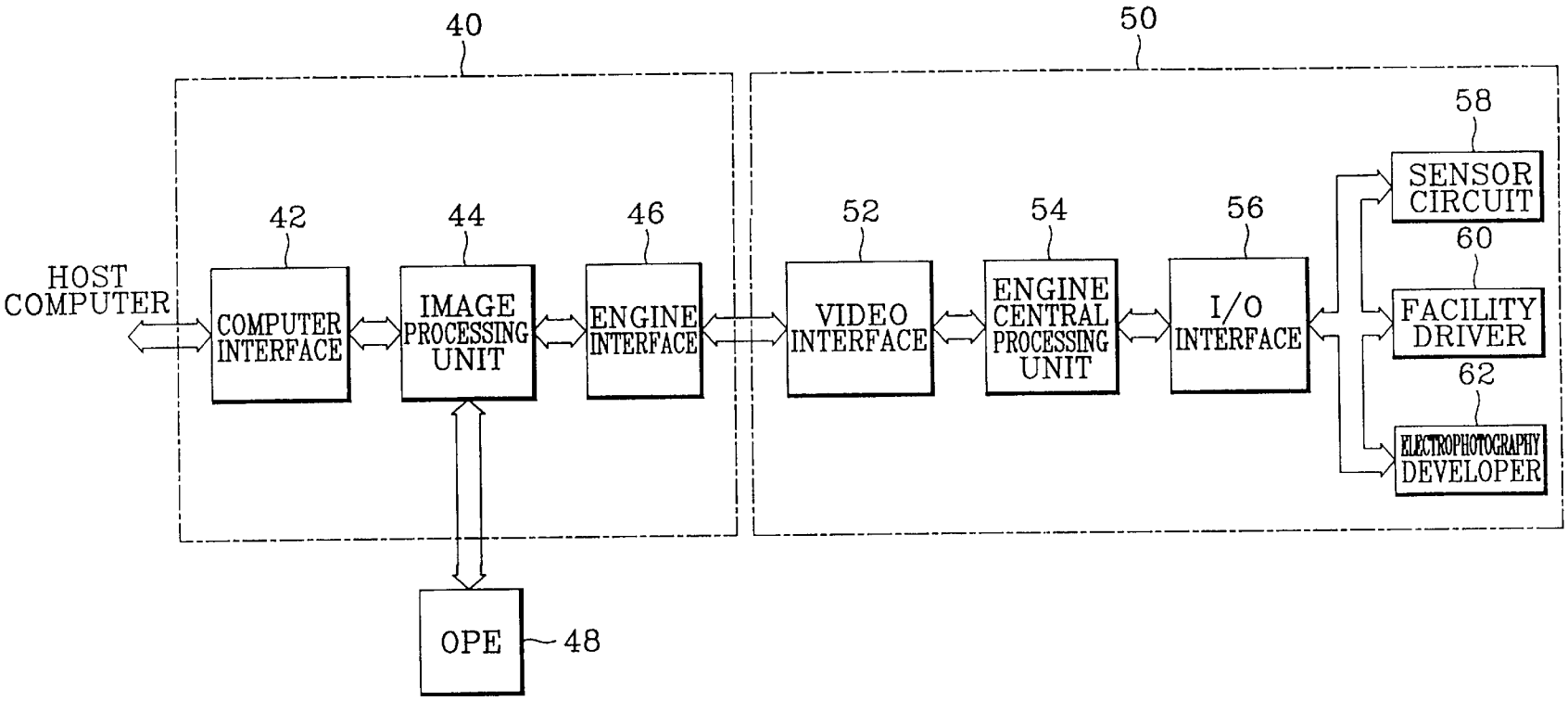
FIG. 3 is a block diagram of the exemplary laser beam printer.

Referring now to FIG. 3 which is a block diagram of a laser beam printer using an electrophotographic process according to the principles of the present invention. The laser beam printer includes a video control unit 40, a print engine unit 50, and an operational panel OPE 48. Video control unit 40 includes a computer interface 42, an image processing unit 44, and an engine interface 46. Computer interface 42 is connected between a host computer and image processing unit 44 for transferring input/output signals.

Video control unit 40 converts data from computer interface 42 into image data so that it can be processed by printer engine unit 50. Image processing unit 44 includes a read-only-memory (ROM) containing a control program and a table of transfer voltages and fusing temperatures for different types of paper such as a thin paper, a normal paper and a special thick paper, and a random-access-memory (RAM) for temporarily storing various data produced by the host computer and OPE 48. While the different type of paper in the preferred embodiment of the present invention is characterized in terms of the paper thickness, different paper sizes may also be included in the control program for reliable fixing of a toner image onto the paper which is fed through a manual feed option (MFS). Image processing unit 44 converts input data received by computer interface 42 into image data which can be processed by printer engine unit 50 according to the operating program, and then sends the converted image data to the printer engine unit 50.

Engine interface 46, which is connected between image processing unit 44 and printer engine unit 50, transfers input/output (I/O) signals to and from printer engine unit 50 under the control of image processing unit 44. The OPE 48 is equipped with a set of input keys such as a paper selection key for allowing the user to make selection between the printing of a thin paper, a standard paper and a thick paper, through which control commands that are sent to the printer, and a display unit for providing a visual display of status information during the printing operation.

Printer engine unit 50 includes a video interface 52, an engine central processing unit (CPU) 54, an input/output (I/O) interface 56, a sensor circuit 58, a facility driver 60, and a developing unit 62, and is connected to video control unit 40. Video interface 52 links video control unit 40 with engine CPU 54. Under the control of image processing unit 44, engine CPU 54 has control over facility driver 60 and developing unit 62, and prints images corresponding to the image data from video control unit 40.

The engine CPU 54 monitors for operating failures which occur in the printer engine unit 50 such as paper feeding, paper conveyance, etc. with the sensor circuit 58. The I/O interface 56 is connected between the engine CPU 54, the sensor circuit 58, the facility driver 60, and the developing unit 62 in order to link the engine CPU 54 with the sensor circuit 58, the facility driver 60 and the developing unit 62. The sensor circuit 58 controls sensors which monitor the operating state of each of the components, the paper conveyance state, and the amount of toner, and transmits output signals of the sensors to engine CPU 54. The facility driver 60 actuates various operating components of the laser beam printer used for paper feeding, paper conveyance, and printing operation. Developing unit 62 prints images under the control of engine CPU 54.

Figure 4:
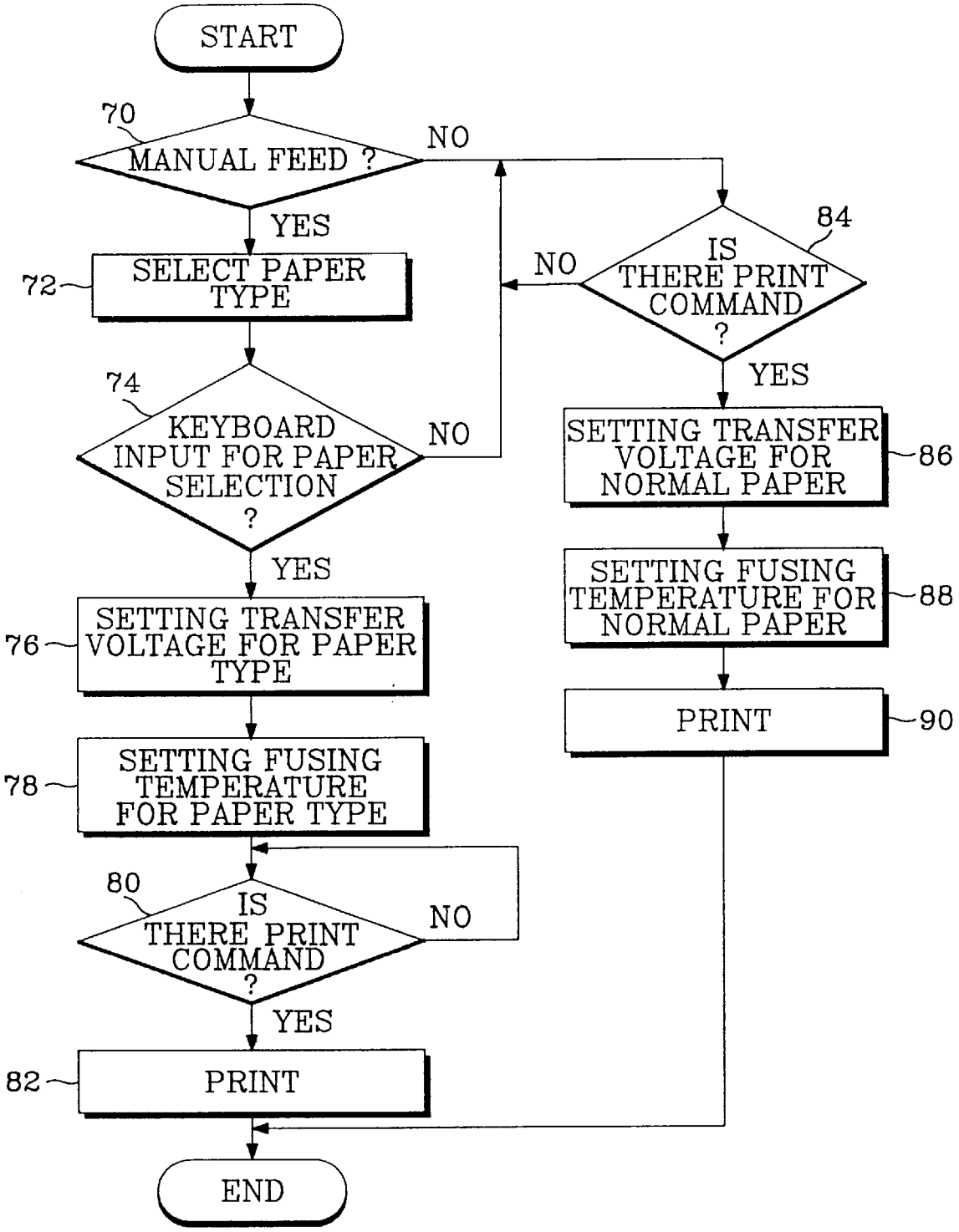
FIG. 4 is a chart of the control sequence of the video control unit for adjusting the printer's transfer voltage and fusing temperature according to the type of paper.

FIG. 4 is a flow chart of the control sequence of a video control unit for setting the printer's transfer voltage and fusing temperature according to the paper type such as a thin paper, a normal paper and a special thick paper. The following description relates to the steps of controlling the printer transfer voltage and fusing temperature according to the type of paper used. This control sequence is described with reference to FIGS. 1 to 4.

When the laser beam printer as shown in FIG. 1 is in a standby mode, the image processing unit 44 monitors whether the manual feed option (MFS) has been selected by the user at step 70. In other words, the image processing unit 44 determines if the manual feed option has been selected by analyzing the output signal of the first sensor S1 located between the manual feed slot and second idle roller 28. When the paper is being fed into the printer through the MFS at step 70, the image processing unit 44 asks the user to select the type of paper through the display unit of the OPE 48 at step 72. The image processing unit 44 then checks if a keyboard paper selection entry has been made by analyzing the output signal from the OPE 48. If there has been no keyboard input for paper selection, the image processing unit 44 proceeds to step 84, and checks for a print output command from the host computer. Upon a command to print from the host computer, image processing unit 44 sets the printer's transfer voltage for normal paper at step 86 and the fusing temperature for normal paper at step 88, and then allows an input image to be printed on paper at step 90.

Alternately, if the keyboard input for paper selection from the OPE 48 has been made, the image processing unit 44 sets a transfer voltage according to the type of paper selected by the user at step 76. The paper selection key can be adjusted for the thickness (or weight) of paper such as thin, thick, and normal paper.

Image processing unit 44 sets the printer fusing temperature according to the input paper selection key of Step 74. Set values for the transfer voltage and fusing temperature according to the type of paper are determined by a table of value that is stored in the ROM. The image processing unit 44 checks for a command to print from the host computer. Upon receipt of a print command at step 80, the image processing unit 44 controls the printing operation at step 82 with the transfer voltage and fusing temperature set in step 76 and step 78. When multiple sheets of paper are continuously fed into the printer through the manual feed slot, the image processing unit 44 repeats step 70 and step 82. Conversely, where there is no paper fed through the manual feed slot, the image processing unit 44 automatically returns the current mode of operation to a normal paper mode. The normal paper default values for transfer voltage and fusing temperature are set.

According to the present invention, the laser beam printer's mode is automatically changed into the paper selection mode when paper is fed into the printer through the manual feed slot thereby eliminating multiple keyboard entries and enhancing the operation efficiency. When the laser beam printer prints on special paper which is thinner or thicker than normal, the present invention adjusts the printer's transfer voltage and fusing temperature to be adequate for the type of paper, so that the best possible print quality is achieved. When the printing operation is completed in paper selection mode, the printer's current mode automatically returns to the normal paper mode to thereby avoid operational delays caused by multiple keyboard inputs. The present invention is also applicable to copy machines, some facsimile equipments, and other apparatus employing electrophotography.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. For example, the type of paper can be characterized in terms of the width size such as small paper (A5 sheets), full paper (8½"×11", B5, A4 and executive sheets), and envelopes. A control program as stored in the image processing unit 44 can be configured to relate optimal transfer voltages and fusing temperatures for the specific type of paper fed into the manual feed option. Therefore, it is intended that the present invention not be limited to the particular embodiment disclosed as the best mode contemplated for carrying out the present invention, but that the present invention includes all embodiments falling within the scope of the appended claims.

What is claimed is:

1. A method of automatically controlling a transfer voltage and a fusing temperature in a printer according to different type of recording medium by an automatic mode change during manual paper feeding, said method comprising the steps of:

when a user feeds a recording medium into a manual feed section of the printer, automatically converting the printer's normal paper mode into a paper selection mode and requesting a user to make selection of the type of recording medium usable for printing operation; and when the user selects the type of recording medium usable for printing operation via a key input, setting the transfer voltage and fusing temperature according to said key input and printing images corresponding to image data from a host computer system onto said recording medium as said recording medium is being fed through said manual feed section of the printer.

2. The method of claim 1, further concurrently generating a visual display of a message requesting the user to make selection of the type of recording medium on an operational panel when the recording medium is fed into the manual feed section of the printer.

3. The method of claim 2, further determining whether the recording medium is fed into the manual feed section of the printer by analyzing an output signal from a sensor located adjacent to the manual feed section to sense the manual feeding of the recording medium into the printer.

4. The method of claim 3, further converting the paper selection mode back to the normal paper mode, when the recording medium has not been fed into the printer through the manual feed section after completing the printing in the paper selection mode.

5. The method of claim 1, further comprised of said recording medium exhibiting one of a first, second and third different thicknesses respectively corresponding to a thin paper, a standard paper, and a thick paper.

6. The method of claim 5, further comprising:

determining whether a print command has been input to the printer, when there is no input of the recording medium via the manual feed section of the printer; and setting the transfer voltage and fusing temperature at standard values established for fixing images onto said recording medium exhibiting said second thickness corresponding to the standard paper, and printing images corresponding to image data from said host computer system onto said recording medium.

7. A method of automatically controlling a transfer voltage and a fusing temperature of an image forming apparatus in accordance with variations of paper characteristics by an automatic mode conversion during manual paper feeding, comprising the steps of:

when a manual feed option is selected, displaying a message requesting input of the type of paper usable for printing operations on an operational panel;

when information identifying the type of paper usable for printing operations is input through the operational panel, adjusting the transfer voltage and fusing temperature according to said input;

when a print command is received from an external computer system, printing images from said external computer system on said paper on the basis of the adjusted transfer voltage and fusing temperature as said paper is being fed into the apparatus through a manual feed slot; and when the paper is no longer fed into the apparatus through said manual feed slot, returning the settings of the transfer voltage and fusing temperature for normal paper.

8. The method of claim 7, further comprised of said paper exhibiting one of a first, second and third different thicknesses respectively corresponding to a thin paper, a standard paper, and a thick paper.

9. The method of claim 8, further comprising:

determining whether a print command is received from the external computer system, when there is no selection of said manual feed option; and setting the transfer voltage and fusing temperature at standard values established for fixing images onto standard paper, and printing images corresponding to image data from said external computer system onto said standard paper.

10. An image forming apparatus for controlling a transfer voltage and a fusing temperature for fusing a toner image on a recording medium in accordance with variations of recording medium characteristics, comprising:

means for forming a toner image on the surface of the recording medium;

a fixing unit including a fuser roller and a pressure roller held in pressure contact with said fuser roller, for fixing said toner image on the surface of the recording medium;

a manual feed slot for allowing manual input of recording medium for image forming operations;

a paper cassette for containing a stack of recording media;

an operational panel including a keyboard having a plurality of discrete keys that are independently operable by manual depression to generate different control functions, and a display unit for providing a visual display of operation of the apparatus;

a controller for regulating a fusing temperature for fixing said toner image on the surface of the recording medium in accordance with variations of recording medium characteristics by:

when a manual feed option is selected, providing a visual display of a message requesting selection of the type of recording medium usable for image forming operations on said operational panel;

when information identifying the type of recording medium usable for image forming operations is selected through said operational panel, adjusting the transfer voltage and the fusing temperature according to said selection;

when a print command is received after the fusing temperature has been adjusted for the type of recording medium selected, printing images on said recording medium on the basis of the adjusted fusing temperature as said recording medium is being fed into the apparatus through said manual feed slot; and when said recording medium is no longer fed into the apparatus through said manual feed slot, returning to the fusing temperature previously established for fixing the toner image on the surface of individual recording medium contained in said paper cassette.

11. The image forming apparatus of claim 10, further comprised of said recording medium exhibiting one of a first, second and third different thicknesses respectively corresponding to a thin paper, a standard paper, and a thick paper.

12. The image forming apparatus of claim 11, further comprised of said recording medium contained in said paper cassette exhibiting said second thickness corresponding to the standard paper.

13. The image forming apparatus of claim 12, further comprised of said controller comprising:

determining whether a print command is received from a host computer system, when there is no selection of said manual feed option; and setting the fusing temperature at a standard value established for fixing the toner image on the surface of the standard paper, and printing images corresponding to image data from said host computer system onto said standard paper.

14. A printer, comprising:

a manual feed slot for allowing manual input of a recording medium for image forming operations;

a paper cassette for containing a stack of recording media;

an operational panel including a keyboard having a plurality of discrete keys that are independently operable by manual depression to generate different control functions;

means for forming a toner image on the surface of said recording medium;

a fixing unit for fixing said toner image on the surface of said recording medium;

a controller for automatically converting, in response to input of said recording medium via said manual feed slot, into a paper selection mode and requesting user's selection of the type of recording medium usable for printing operations, and for automatically setting a transfer voltage and a fusing temperature in accordance with said user's selection via said key input for said printing operations as said recording medium is being fed via said manual feed slot.

15. The printer of claim 14, further comprised of said controller further providing a visual display of a message requesting selection of the type of recording medium usable for image forming operations on said operational panel.

16. The printer of claim 15, further comprised of said controller automatically adjusting the transfer voltage and the fusing temperature when the type of recording medium usable for printing operations is selected by said user via said operational panel.

17. The printer of claim 16, further comprised of said controller further printing images on said recording medium on the basis of the adjusted fusing temperature as said recording medium is being fed via said manual feed slot, when a print command is received after the fusing temperature has been adjusted for the type of recording medium selected.

18. The printer of claim 17, further comprised of said controller returning to the fusing temperature previously established for fixing the toner image on the surface of individual recording medium contained in said paper cassette when said recording medium is no longer fed through said manual feed slot.

19. The printer of claim 18, further comprised of said recording medium contained in said paper cassette corresponding to a standard paper.

20. The printer of claim 14, further comprised of said recording medium exhibiting one of a first, a second and a third different thickness respectively corresponding to a thin paper, a standard paper, and a thick paper.

* * * * *